US005629723A

United States Patent [19]

West et al.

[11] Patent Number: 5,629,723

[45] Date of Patent: May 13, 1997

[54] GRAPHICS DISPLAY SUBSYSTEM THAT ALLOWS PER PIXEL DOUBLE BUFFER DISPLAY REJECTION

[75] Inventors: Roderick M. P. West, Colchester; Edward K. Evans, Essex Junction, both of Vt.

[73] Assignee: International Business Machines Corporation, Armonk, N.Y.

[21] Appl. No.: 528,866

[22] Filed: Sep. 15, 1995

[51] Int. Cl.[6] ..... G09G 5/00

[52] U.S. Cl. ..... 345/201; 345/203

[58] Field of Search ..... 345/201, 189, 345/200, 203, 185

[56] References Cited

U.S. PATENT DOCUMENTS

| | | | |
|---|---|---|---|
| 4,668,994 | 5/1987 | Takahashi et al. | 345/201 |
| 4,700,181 | 10/1987 | Maine et al. | 345/201 |
| 4,823,108 | 4/1989 | Pope | 345/120 |
| 4,864,517 | 9/1989 | Maine et al. | 345/201 |
| 4,875,034 | 10/1989 | Brokenshire | 345/120 |
| 4,910,683 | 3/1990 | Bishop et al. | 345/201 |
| 4,945,495 | 7/1990 | Ueda | 395/130 |
| 5,061,919 | 10/1991 | Watkins | 345/115 |
| 5,065,368 | 11/1991 | Gupta et al. | 365/230 |
| 5,101,365 | 3/1992 | Westberg et al. | 345/201 |
| 5,264,837 | 11/1993 | Buehler | 345/115 |
| 5,300,948 | 4/1994 | Tsujido et al. | 345/115 |
| 5,402,147 | 3/1995 | Chen et al. | 345/115 |
| 5,426,725 | 6/1995 | Kilgore | 345/113 |
| 5,452,235 | 9/1995 | Isani | 345/201 |
| 5,457,482 | 10/1995 | Rhoden et al. | 345/201 |
| 5,543,824 | 8/1995 | Priem et al. | 345/201 |

OTHER PUBLICATIONS

Aranda, M. & Henderson, R.L., "Dual Frame Buffer . . . ", IBM Technical Disclosure Bulletin, vol. 36 No. 04, Apr. 1993.

*Primary Examiner*—Richard Hjerpe
*Assistant Examiner*—Ricardo L. Osorio
*Attorney, Agent, or Firm*—Robert A. Walsh; Andrew J. Dillon

[57] ABSTRACT

A graphics display subsystem that allows rejection of double buffer display of pixel data in a graphics layer is provided. The subsystem has a memory containing a plurality of pixels represented by binary bits, wherein each pixel is divided into two or more sub-pixel fields, and wherein one or more bits of a particular sub-pixel field of a given pixel are set to a predetermined double buffer reject value when the given pixel corresponds to a single buffer display application. A double buffer reject circuit compares one or more bits of a double buffer sub-pixel field of a given pixel with a predetermined double buffer reject value to determine equality of the one or more bits and the predetermined value, wherein the given pixel is represented by binary bits and wherein the given pixel is divided into two or more sub-pixel fields including the double buffer sub-pixel field. The double buffer reject circuit receives a buffer select signal selecting one of the two or more sub-pixel fields of the given pixel to be accessed during a current display frame. In response, the double buffer reject circuit accesses the selected sub-pixel field of the given pixel when the buffer select signal does not select the double buffer sub-pixel field or when the buffer select signal selects the double buffer sub-pixel field and the comparison does not show equality, and further the double buffer reject circuit accesses one of the two or more sub-pixel fields of the given pixel that is not the double buffer sub-pixel field when the buffer select signal selects the double buffer sub-pixel field and the comparison shows equality. A digital-to-analog converter in communication with the double buffer reject circuit receives the pixel data contained in the sub-pixel field accessed by the double buffer reject circuit and converts the pixel data into analog video signals for driving a monitor display device.

21 Claims, 3 Drawing Sheets

GRAPHICS DISPLAY SUBSYSTEM THAT ALLOWS PER PIXEL DOUBLE BUFFER DISPLAY REJECTION

BACKGROUND OF THE INVENTION

1. Technical Field

The present invention relates in general to computer graphics systems and subsystems, and in particular to computer graphics subsystems having a double buffer display capability.

2. Description of the Related Art

In computer graphics, an image to be displayed is divided into a number of discrete picture elements or pixels. Each pixel represents a physical position on the output display monitor and can have associated with it a color or specific shade of gray. In image and graphics systems, the pixels of a display are each represented by a value stored in a memory device. This memory device storing this representation of a display is typically referred to as a frame buffer. A high resolution display, typically has an image of 1600×1280 or 2,048,000 pixels. Each pixel value can be represented by 1 to 32 or more bits, thus requiring a large amount of memory to store the image. This requirement for large amounts of high speed memory requires the use of high density memory devices, such as Dynamic Random Access Memories ("DRAMs").

The nature of video display scan patterns and update rates requires decoupling the updating of the frame buffer from the scanning out of the stored values (through video generation circuitry) for display on the video monitor. Consequently, a specialized form of DRAM memories, called Video RAMs (VRAMs), were developed for simultaneously displaying the contents of a graphics frame buffer to the screen, while allowing the graphics or image processor to update the frame buffer with new data. Video RAMs contain two Input/Output ports (one for random access and one for serial access) and one address port. These memories are frequently referred to as dual-port memories.

In general, workstation graphics, and in particular multimedia workstation displays, provide a double buffer display capability. Double buffer display was originally devised to provide a seamless change between updated display frames. While one buffer is being displayed, the other buffer can be updated without any unwanted front-of-screen artifacts occurring. When the update of that buffer is completed, and just after the end of the current display frame, the buffer select can be switched, allowing the display of the newly updated buffer in the next frame. The process repeats itself in the next frame where the newly updated buffer is displayed and the other buffer is updated with data for display in a later frame. In this way, double buffer display provides a means whereby the actual update of the display data can be hidden from the viewer, allowing the results of that update to be brought to the display instantly once the update is complete.

This double buffer display capability has particular value in 3D, Scientific Visualization, Computer Animation and Digital Video applications. In 3D and Scientific Visualization applications, an update might take a considerable time. Holding back the display of the new data until its completion provides the viewer with a more acceptable front-of-screen experience. Similarly, in computer animation and digital video applications, it is important that the updates be kept hidden from the viewer until they are complete in order to provide smooth animation and to avoid any breakup in the frames of the displayed sequence.

In advanced workstation graphics, a window displaying a single buffer application and a second window showing a double buffer application may be displayed on the screen simultaneously. This is accomplished by transmitting two types of data for each pixel to the workstation's palette DAC (display digital-to-analog converter): a Window Identifier (WID) and the pixel display data. The WID is a pointer that identifies the window, the application, or the class of pixels to which the pixel belongs. The WID is used by the palette DAC to look up various attributes of that pixel class from a Window Attribute Table (WAT) residing in the palette DAC. The attributes define the format of the pixel data, the presence and number of display layers associated with that pixel data, how that pixel data is to be partitioned between the display layers, the type of processing to be applied to the pixel data of each display layer, and the criteria for determining which layer to display. These attributes of the various pixel classes are loaded into the Widow Attribute Table by the application software running on the workstation.

One of the attributes provided to the Window Attribute Table is used to distinguish between "double buffer" and "single buffer" applications. When the attributes from the WAT (for a given WID) indicate the presence of a double buffer application, the pixel display data having that WID is divided into two sub-pixel fields. These two fields are assigned as Buffer A and Buffer B. A further attribute (Buffer Select) from the WAT indicates which of the two buffers should be processed (according to other attributes) and displayed. By simply changing the Buffer Select attribute in the WAT for a given WID, all double buffer pixels belonging to a double buffer application having that same WID will immediately switch between Buffer A and Buffer B anywhere on the entire display. Alternatively and preferably, the palette DAC device can hold off the switch between Buffer A and Buffer B until the start of the next display frame. Single buffer applications provide only one buffer of data to the palette DAC, and so do not provide a buffer select attribute or, alternatively, have that attribute constantly set to the buffer loaded with single buffer data (for example, Buffer A).

As can be seen, such advanced graphics systems and workstations provide double buffer display capability on a per-window basis. However, the control provided is on a per-pixel basis. This allows applications to be displayed in windows of any arbitrary shape. Through the use of WIDs and the attributes they address in the WAT, double buffer display capability can be applied selectively to any window or set of windows, allowing double buffer applications and single buffer applications to be displayed simultaneously.

Computer software applications that take advantage of the double buffer display capability of advanced computer graphics have traditionally been run on computer workstations. However, an emerging class of applications, such as low-end 3D, digital video, educational and games, are being generated for personal computer (PC) platforms that would be substantially benefitted by a double buffer display capability. Thus, in an attempt to provide double buffer display capabilities on conventional PCs, the prior art has provided a multitude of techniques at a cost that is acceptable for the PC market. Unfortunately, these attempts have resulted in double buffer display systems with substantially reduced functionality and less acceptable front-of-screen experience from that seen on workstation platforms.

One technique for implementing double buffer display on a PC would be to duplicate the Window Identifier/Window Attribute method used in workstation graphics systems.

However, PC graphics systems, operating systems, and graphic user interfaces almost universally do not provide for the use of WIDs or for selective attribute control of the processing of the pixel data. Therefore, PC hardware and GUI/Operating System software would need to be redesigned, including providing additional frame buffer memory to store the additional WIDs and attribute data, additional pins at the input of the palette DAC device, and additional logic and software to handle the WID/WAT mechanism. While it may be possible to redesign PCs to utilize WIDs and attribute data to enhance PC graphics, the additional high-speed, high-density memory and the substantial increase in complexity of the hardware and software that is required would make such a graphics system prohibitively expensive for the low-cost PC market.

Consequently, various known techniques of providing double buffer capabilities for PC graphics have been developed within the constraints of current PC graphics architectures, without incurring the substantial increased cost associated with providing additional attribute registers and attribute handling circuitry. These methods have several drawbacks, however.

In one technique, a single buffer select register in the Palette DAC is written by a double buffer application being displayed. This register is loaded with a double buffer select signal that indicates which of the two buffers is to be displayed during the current display frame. If only single buffer applications are displayed, then the buffer select register is loaded (or preset) to select a first buffer for every display frame. If a double buffer application is being displayed at the same time as one or more single buffer applications, the buffer select register is alternately loaded to select between the first and a second frame buffer every given number of display frames.

While this enables double buffer display, it introduces severe limitations on the PC graphics system because it is necessary for the entire screen to act as a double buffer display when any double buffer application is to be displayed within a given frame. In other words, it is impossible to constrain double buffer displays to a specific window on a screen. This creates a necessity for duplicating data from any single buffer applications in both buffers to prevent blanking of the single buffer display data when the second buffer is selected. Therefore, when an application directs that the display pixel data is to be displayed as a double buffer display, half of the data transferred from the system's VRAM to the palette DAC for each pixel is dedicated to Buffer A, while the other half is dedicated to Buffer B. For example, the application's pixel data may be handled by the graphics system as 32 bit-per-pixel data, but, when the pixel data reaches the palette DAC, it is split into two 16 bit-sub-pixel fields with the lower 16 bits being assigned as Buffer A and the upper 16 bits being assigned as Buffer B. The palette DAC is then programmed (via the select signal) to select either Buffer A or Buffer B for an entire given display frame. When one or more single buffer applications are displayed at the same time as the double buffer application, the display data for the single buffer applications must be duplicated in both halves of the pixel data (i.e. in both buffers). Otherwise, the display of the single buffer application would disappear from the screen during the frames in which the non-loaded buffer is selected. This duplication of pixel data has the potential effect of halving the performance of all single buffer applications, including the window management functions of any graphical user interface. Any such reduction in performance is at best annoying and at worst may prove to be unacceptable to the user.

Another technique provides two physically separate frame buffers for Buffer A and Buffer B that are multiplexed into the palette DAC device. This technique, without double buffer capability, is simpler to implement since the palette DAC device is a standard palette DAC programmed to process pixel data in the format associated with a single buffer. In this technique, the double buffer display is provided by switching between one physical frame buffer and the other by enabling or selecting one buffer, while disabling or deselecting the other. Just as with the first technique, all single buffer applications require the duplication of their display data in both of the physically separate frame buffers so that they do not disappear from the screen when the double buffer is switched. This technique also exhibits the potentially unacceptable effect of halving the performance of all single buffer applications.

Still another technique includes the buffer select signal within the pixel display data of each pixel. Each pixel has two sub-pixel fields (Buffer A data and Buffer B data) and a buffer select bit. When the palette DAC converts a pixel, it accesses the sub-pixel field indicated by the select bit to retrieve the display pixel data. If the pixel is a single buffer display, the select bit is always set to the same sub-pixel field (Buffer A), so that only one buffer for that pixel needs to be loaded in this technique. If a double buffer application is being displayed at the pixel, the select bit for every double buffer pixel must be rewritten every new data frame to alternate the data displayed between the first sub-pixel field and the second sub-pixel field. It can be seen that this technique consumes a substantial amount of bandwidth because every double buffer pixel must be written at every new data frame to switch the select bit, after the pixel data for the new frame has been changed. This continuous rewriting of the frame buffers has a substantial effect on the performance of the graphics systems's display of both the single and double buffer applications. In addition, because a significant amount of time is required, every pixel must be rewritten to change all the double buffer select bits, therefore, it is difficult to synchronize the frame change to the start of the next display frame.

It is readily apparent from the aforementioned problems that there is a need in the field of computer graphics for a double buffer display capability in PC graphic systems that does not degrade the performance of the display when single buffer applications are displayed simultaneously with double buffer applications. Moreover, it would be desirable for such a capability to be easily incorporated into current PC graphics architectures without requiring the addition of prohibitively expensive memory and a significant redesign of system architecture.

SUMMARY OF THE INVENTION

According to the present invention, a graphics display subsystem that allows rejection of double buffer display of pixel data in a graphics layer is provided. The subsystem has a double buffer reject circuit that compares one or more bits of a double buffer sub-pixel field of a given pixel with a predetermined double buffer reject value to determine equality of the one or more bits and the predetermined value, wherein the given pixel is represented by binary bits and wherein the given pixel is divided into two or more sub-pixel fields including the double buffer sub-pixel field. The double buffer reject circuit receives a buffer select signal selecting one of the two or more sub-pixel fields of the given pixel to be accessed during a current display frame. In response, the double buffer reject circuit accesses the selected sub-pixel field of the given pixel when the buffer select signal does not select the double buffer sub-pixel field or when the buffer select signal selects the double buffer sub-pixel field and the comparison does not show equality, and further the double buffer reject circuit accesses one of the two or more sub-pixel fields of the given pixel that is not the double buffer sub-pixel field when the buffer select signal selects the double buffer sub-pixel field and the comparison shows equality. The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
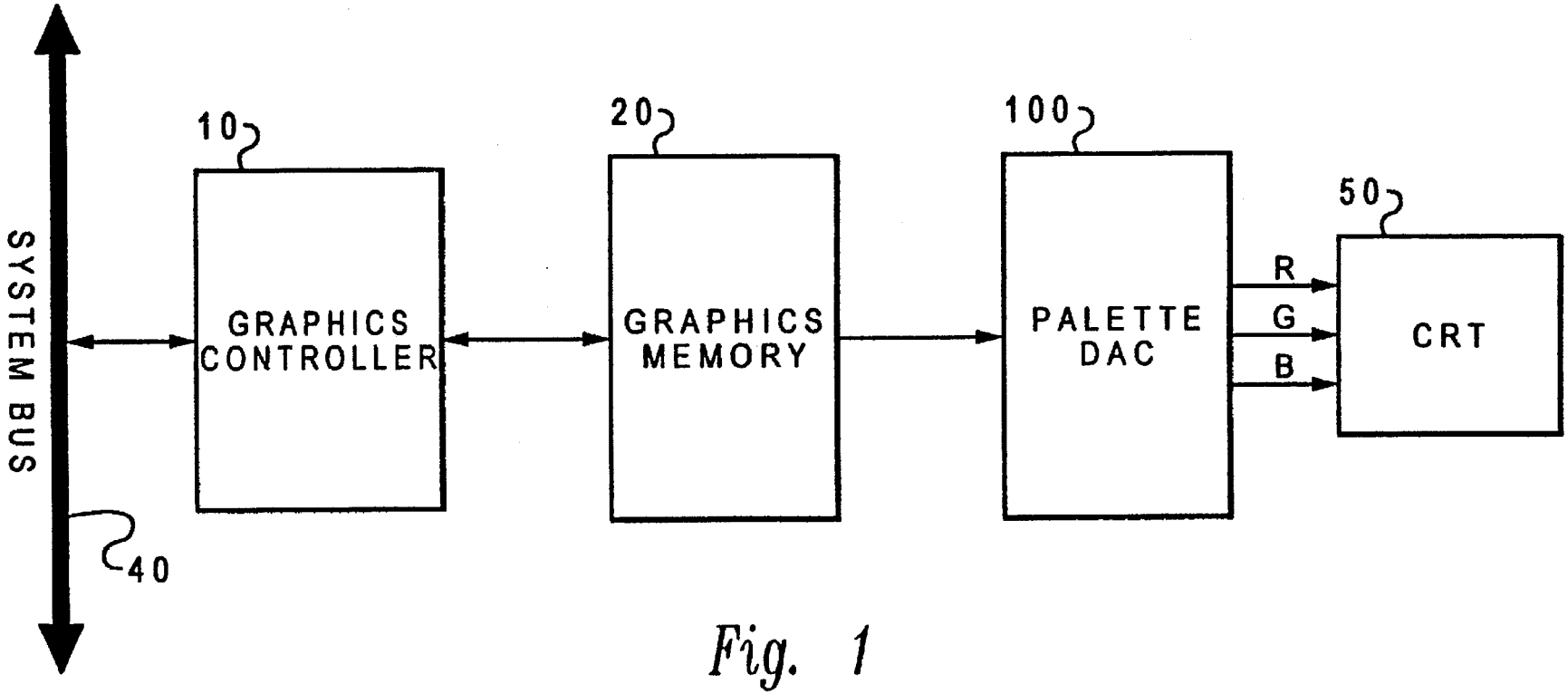
FIG. 1 depicts a block diagram of a graphics display system as used in an embodiment of the present invention.

With reference now to the figures, and in particular with reference to FIG. 1, there is depicted a block diagram of a graphics display system as used in a preferred embodiment of the present invention. The graphics display system includes graphics controller 10, graphics memory (VRAM) 20, and graphics digital-to-analog converter (Palette DAC) 100. The Palette DAC is sometimes referred to as a "RAM-DAC" or as a "LUT-DAC". System bus 40 connects the graphics display system to the rest of the computer system. Graphics controller 10 receives information to be displayed on a CRT display from a central processing unit (not shown) connected to the system bus 40. Graphics controller 10 transmits display pixel data, addressing information, and control signals to update graphics memory 20. Graphics memory 20 provides serial pixel data on a serial data bus to Palette DAC 100. Palette DAC 100 processes the received display pixel data and converts it into analog signals that drive the attached display device 50 (usually a CRT) for presentation as a visual image.

Figure 2:
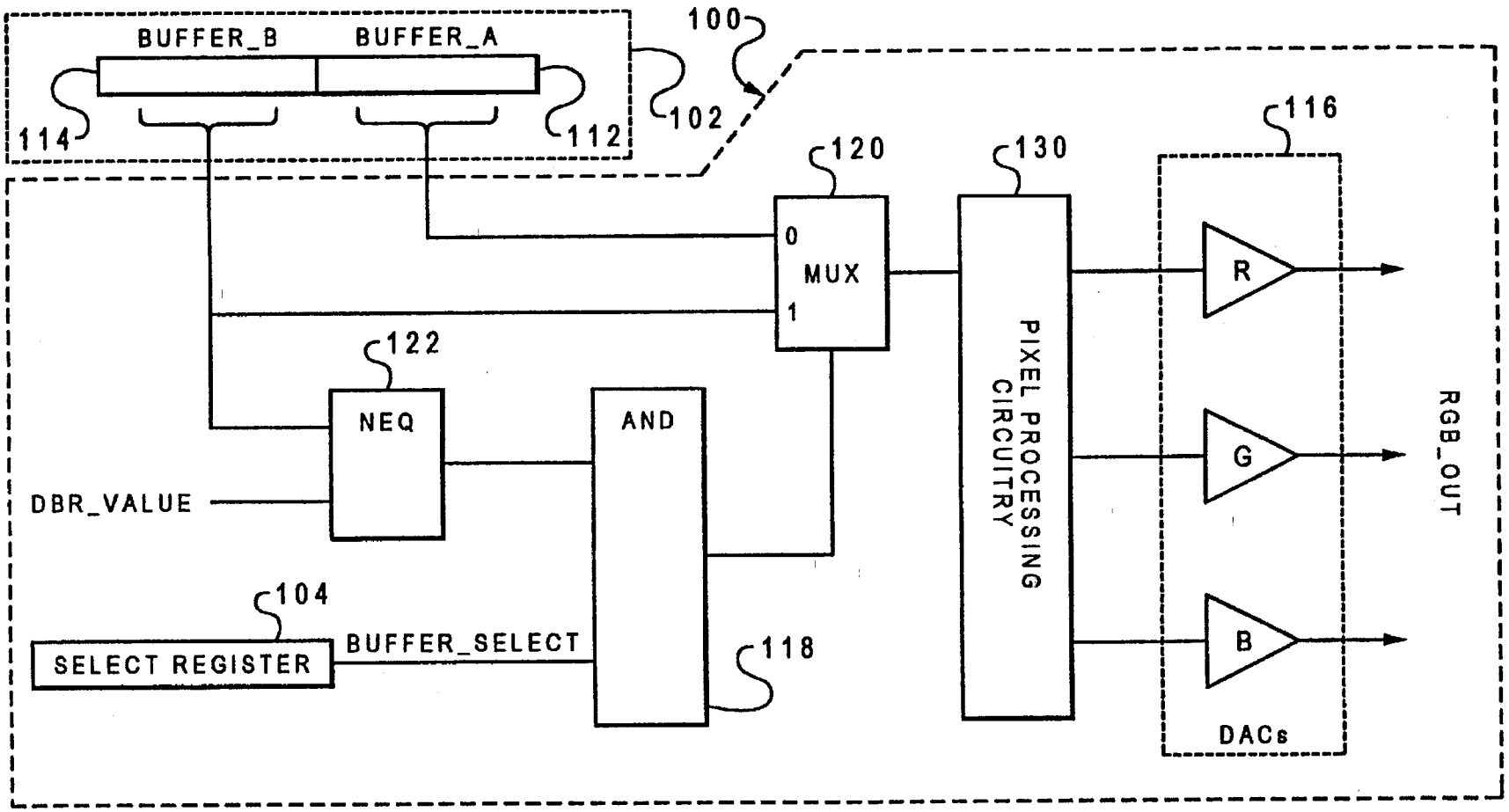
FIG. 2 shows a block diagram of a palette DAC that enables per pixel double buffer rejection of pixel data in a graphics layer, in accordance with a preferred embodiment of the present invention.

Referring now to FIG. 2, there is shown a more detailed diagram of palette DAC 100 shown in FIG. 1, which enables per pixel double buffer rejection of pixel data in a graphics layer, in accordance with a preferred embodiment of the present invention. Graphics memory 20 contains one or more frames of display data, wherein each frame is comprised of a plurality of pixels and each pixel has two or more sub-pixel fields. As seen in FIG. 2, each pixel 102 from the graphics memory 20 is divided into a first sub-pixel field 112 (Buffer_A) and a second sub-pixel field 114 ($Buffer_{13}$ B). Buffer_A and Buffer_B are provided to palette DAC 100 simultaneously, using this double buffer pixel format. For example, a 32 bit pixel would be processed by palette DAC 100 as having two 16 bit sub-pixel fields. When the palette DAC 100 is programmed for a double buffer application, the palette DAC operates on the display pixel data using the double buffer pixel format by processing either the Buffer_A data or the Buffer_B data.

As will be appreciated by those skilled in the art, memory device 20 is a high speed DRAM device such as a VRAM. Pixel data 102 stored in memory device 20 is logically divided into two logical buffers, Buffer_A and Buffer_B, each containing one of the two sub-pixel fields for each pixel. Alternatively, each of the logical buffers may be stored in a physically separate device. It is intended that the present invention may be embodied in any type of memory configuration and that the present is not limited to the described memory configuration of the preferred embodiment of the present invention.

As shown in FIG. 2, Buffer_A contains a first frame of display pixel data that is comprised of a plurality of sub-pixel fields 112 represented by binary bits. Buffer_B contains a second frame of display pixel data comprised of a plurality of sub-pixel fields 114 represented by binary bits. As will be appreciated by those skilled in the art, each display pixel is comprised of the two sub-pixel fields 112, 114 contained in Buffer_A and Buffer_B, respectively. For example, a 16 bit-per-pixel double buffer application would be loaded into the system's VRAM as a 32 bit-per-pixel application. A particular display frame (i.e. Buffer) is selected and the 16 bits in the selected sub-pixel field 112, 114 is processed and converted by palette DAC 100.

As seen in FIG. 2, the BUFFER_SELECT signal is used in conjunction with the double buffer reject circuit of the present invention to select one of $Buffer_{13}$ A and Buffer_B to be accessed, and its pixel data output to pixel processing circuitry 130. Pixel processing circuitry includes color lookup tables ("palettes"), gamma correction tables, color space conversion, direct color expansion and direct color bypass circuitry, all of which process the accessed pixel data in accordance with known techniques. The processed pixel data is thence output to RGB DACs 116 for conversion into the analog video signals (RGB_OUT) for driving a monitor display device.

According to the present invention, if a particular display pixel is being provided by a single buffer application, only a single buffer (Buffer_A) is loaded with that display pixel data. When the attributes from a double buffer application indicate the presence of a double buffer display, the pixel display data is divided into the two sub-pixel fields 112, 114 (i.e. Buffer_A and Buffer_B). A further attribute is written in the buffer select register 104 by the double buffer application being displayed selecting the frame to be displayed, wherein the BUFFER_SELECT signal output from buffer select register 104 (Select Register) indicates which of the sub-pixel fields 112, 114 should be processed and displayed during the current display frame. If only single buffer applications are being displayed, the buffer select register 104 is loaded (or preset) to select a first buffer (for example, Buffer_A) for every display frame. If a double buffer application is also being displayed, the buffer select register is alternately loaded to select between the first and a second buffers every given number of display frames.

As seen in FIG. 2, if the BUFFER_SELECT signal is a binary "0", indicating Buffer_A, ANDgate 118 outputs a "0" to multiplexer 120, which in turn selects Buffer_A accessing port "0". Multiplexer 120 outputs the accessed buffer's display pixel data to the pixel processing circuitry 130 and thence to DACs 116 to produce the current display frame. During the display of this frame, if a double buffer application is being displayed for a set of particular pixels, Buffer_B is updated by a double buffer application with a new frame of display pixel data for those double buffer pixels. When the update of Buffer_B is completed, and just after the end of the current display frame, the double buffer application writes to buffer select register 104 (SELECT REGISTER), causing the BUFFER_SELECT signal to switch to a binary "1", which indicates the selection of Buffer_B for display. Although some double buffer applications switch the buffer select signal every display frame, other applications, such as computer animation, switch display flames less frequently to be generally timed to the frame rate of the animation data but synchronized to the display frame rate. For example, the animation data will generally have a frame rate of between 15 and 30 frames per second, while the display frame rate is likely to be in excess of 75 frames per second, so each animation frame (each buffer) will be displayed for between 2 and 5 display flames, with a buffer switch timed to one of the frame blanking periods between flames.

In accordance with the present invention, Buffer_B is pre-programmed with a double buffer reject value for every pixel of the stored frame. This reject value (or range of values) is a predetermined one or more bits of sub-pixel field 114. This reject value is a unique number (or range of numbers) that cannot be used by standard pixel data in the second buffer (Buffer_B). Its significance, in accordance with the present invention, is that a pixel loaded with this reject value is rejecting double buffer display of that pixel. Whether or not some of the pixels displayed on the screen by palette DAC 100 are in a double buffer pixel format, the display pixel data contained in Buffer_A would be displayed for all pixels and all applications when Buffer_A is selected by the BUFFER_SELECT signal. When buffer select register 104 is programmed to output a BUFFER_SELECT signal that selects Buffer_B, the sub-pixel data for that pixel contained in Buffer_B is compared against the pre-programmed double buffer reject value (DBR_VALUE) or rage of values. If no match occurs in the comparison by the "not_equal" comparator 122 (NEQ), then palette DAC 100 processes and displays the data from the sub-pixel field 114. However, if a match occurs between the pixel data contained in that particular sub-pixel field and the double buffer reject value (DBR_VALUE), then the palette DAC 100 rejects the display pixel data in sub-pixel field 114 and instead processes and displays the pixel data in the sub-pixel field 112.

With reference to the above, the operation of the palette DAC of a preferred embodiment of the present invention, as shown in FIG. 2, is now described. During the display of a double buffer pixel, the device driver software will continue to load the buffer select register 104 in palette DAC 100 with alternating values causing the palette DAC to switch between buffers (i.e. providing an alternating BUFFER_SELECT signal). The BUFFER_SELECT signal indicates Buffer_A by "0" and Buffer_B by "1". If a particular display frame includes pixels from a single buffer application, the device driver software will command the graphics controller to fill Buffer_A with valid display pixel data and to fill Buffer_B with the double buffer reject value (if the buffer has not already been preset with the reject value or if a double buffer application is being overwritten). In this embodiment, the double buffer reject value (DBR_VALUE) has a number of bits equal to the number of bits in the entire sub-pixel field 114.

As each pixel is received, the pixel data in Buffer_B of that pixel is checked for a match with the double buffer reject value (DBR_VALUE) in the not-equal logic block (NEQ) 122. The not-equal logic block (NEQ) 122 performs a "not-equal" comparison such that it generates a "1" if there is no match (i.e. they are not equal) and a "0" if a match occurs (i.e. they are equal). For example, as seen in FIG. 2, the entire sub-pixel field 114, for example 16 bits, is compared with a 16 bit double buffer reject value in logic block NEQ 122.

It will be appreciated that the entire pixel data field 114 does not have to be used to make the comparison with the double buffer reject value, and that a number of bits less than the entire pixel field may be used to make the comparison with a double buffer reject value of equal size. For example, 8, 4, 2, or even a single bit of the pixel data could be compared by NEQ 122 with the double buffer reject value of a corresponding equal number of bits (or bit). If the display pixel data for this pixel is for a single buffer application, these particular one or more bits will be set in Buffer_B to indicate that the Buffer_B pixel data for this pixel is to be rejected and the display pixel data in a corresponding sub-pixel field of Buffer_A should be output as the display pixel data. In an alternative preferred embodiment, a specific single bit of the display pixel data would be dedicated as a reject tag. This particular bit, for example, the most significant bit, is set or reset depending upon whether a particular display pixel corresponds to single buffer or to double buffer applications, respectively.

It should be noted that this embodiment of the present invention has a significant advantage over the prior art technique described hereinabove of including the buffer select signal within the pixel data. In the prior art technique, a single buffer select bit of the pixel data is written for every display frame. With this method, every pixel of the display must be reloaded with a switched select bit every frame. In some cases that could mean over two million pixels must be rewritten every single display frame. It will be appreciated that this can have a devastating effect on display performance. With the present invention, a double buffer reject bit is written in a pixel's display data a first time when the Palette DAC is initialized or when a pixel is first written. Thereafter, this bit is written only when a double buffer application takes control of the display of that pixel and when the double buffer gives up control to a single buffer application. In contrast to the prior art technique, the double buffer select signal for every pixel is generated by writing a single value to a single buffer select register for every frame (or a given number of frames). It will be appreciated that by only performing a single write to the palette DAC for every display frame, instead of the potential two million writes, the present invention has unparalleled performance advantages over the prior art.

Referring back to FIG. 2, the output of NEQ 122 and the BUFFER_SELECT signal are logically ANDed by ANDgate 118, which produces an output controlling the multiplexer (MUX) 120. If the output of ANDgate 118 is a "0", the display pixel data of Buffer_A attached to port 0 of multiplexer 120 is accessed to provide the pixel data output to the pixel processing circuitry 130 and thence to the RGB DACs 116. This will occur either if the BUFFER_SELECT signal indicates Buffer_A by a 0, or if the comparison by logic block 122 produces a 0 output indicating that the display pixel data in Buffer_B is equal to the double buffer reject value, forcing double buffer display of Buffer_B to be rejected. If the output of ANDgate 118 is 1, then both the BUFFER_SELECT signal is 1, selecting Frame Buffer_B, and the output of the logic block 122 is 1, indicating that the display pixel data in Buffer_B in not equal to DBR_VALUE. This output from ANDgate 118 selects the display pixel data in Buffer_B attached to port 1 of multiplexer 120 for output to the pixel processing circuitry and thence to the RGB DACs 116. It can be seen that the comparison of the Buffer_B pixel data with the double buffer reject value only affects the output of MUX 120 when Buffer_B is selected by the BUFFER_SELECT signal.

As will be appreciated, the present invention provides a mechanism by which single buffer applications are not required to duplicate their display data in both buffers of graphics memory 20. In the preferred embodiment, all pixel data associated with Buffer_B is initialized to the pre-programmed double buffer reject value. A double buffer application with double buffer display of particular pixels would then override these values with its own Buffer_B data in the affected pixels. When this double buffer application is removed from the screen or partially overwritten by a single buffer application, then the double buffer reject value must be restored to the affected pixels no longer associated with the double buffer application.

It will be appreciated by those skilled in the art that additional logic may be included in the circuit of the present invention shown in FIG. 2 to extend the functionality to allow either or both frame buffers to be rejected when selected such that single buffer applications can store their data in either available buffer. If both buffers are rejected at the same time, then a pre-programmed background color can be displayed. It will be appreciated by those skilled in the art that the functionality of the present invention can be extended to more than two buffers or sub-pixel fields such as with three buffers (triple buffering) or four buffers (quad buffering). As will be appreciated by those skilled in the art, the scope of present invention is intended to extend to such configurations, and that a simple extension of the architecture of the present embodiment will enable such alternative embodiments.

Figure 3:
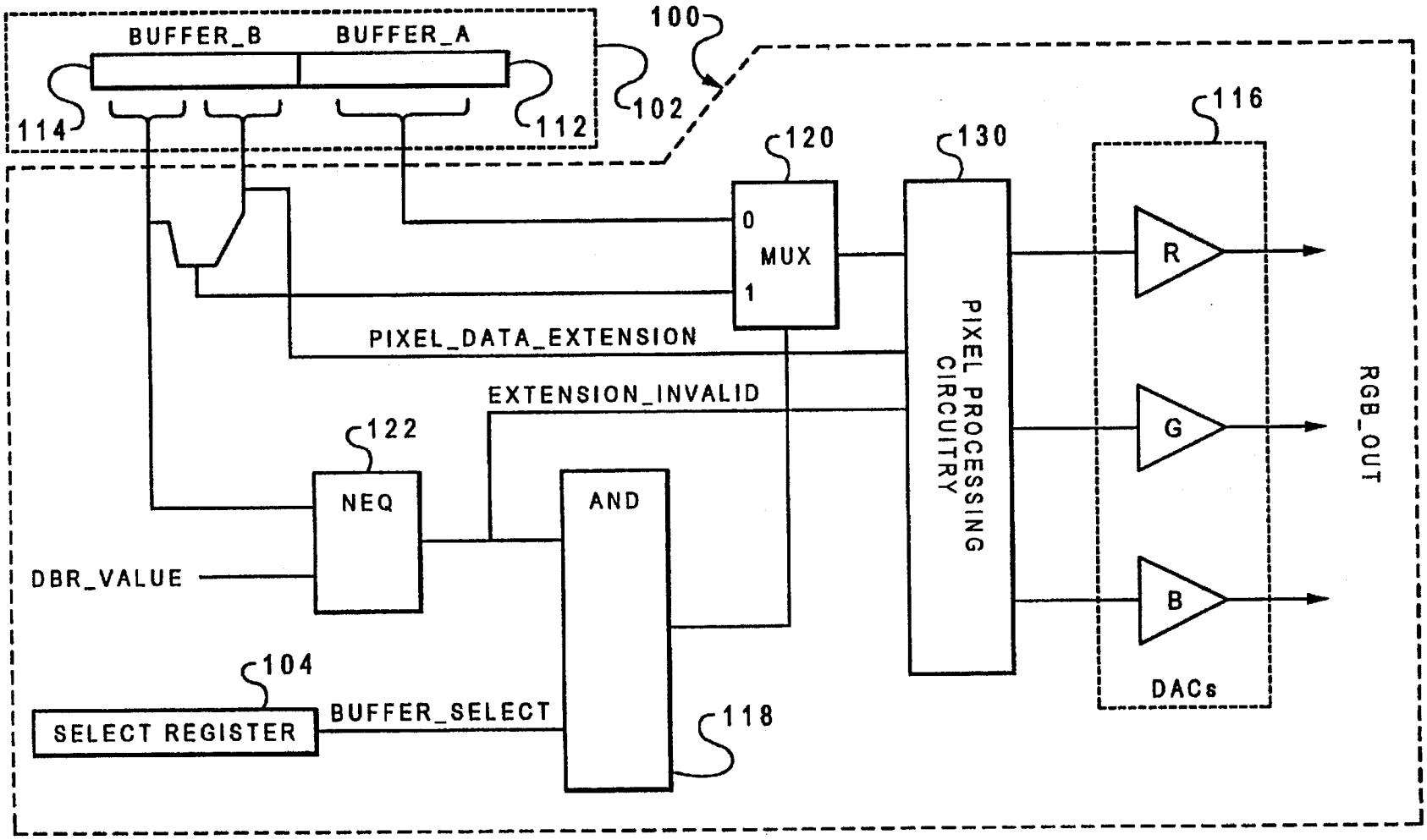
FIG. 3 depicts a block diagram of an alternative preferred embodiment of a graphics display subsystem allowing rejection of double buffer display of pixel data in a graphics layer, in accordance with the present invention.

With reference now to FIG. 3, there is shown an alternative preferred embodiment of a graphics display subsystem allowing rejection of double buffer display of pixel data in accordance with the present invention. In this embodiment, a subset of the display pixel data in the sub-pixel field 114 of Buffer_B is compared with the DBR_VALUE by the not_equal logic block 122. Here, the DBR_VALUE has a number of bits equal to the subset. For example, as see in FIG. 3, the upper half (8 bits) of the pixel data in Buffer_B is input into NEQ 122 and compared with the DBR_VALUE (also 8 bits). In accordance with this embodiment of the present invention, when this pixel is being displayed by a single buffer application, the upper half of the sub-pixel field will contain the double buffer reject value and the single buffer application may use the unused lower order bits of Buffer_B to extend the number of bits available per pixel beyond the number provided by Buffer_A. Thus, when a single buffer application sets the reject bits for a single buffer display pixel in Buffer_B, the remaining bits of the sub-pixel field not used as reject bits may be output as additional pixel data (PIXEL_DATA_EXTENSION). The validity of the extended pixel data is indicated by the EXTENSION_INVALID signal.

In operation, the upper part of the Buffer_B data is checked for a match with the double buffer reject value (DBR_VALUE) in the NEQ logic block 122 that generates a "1" if there is no match and a "0" if a match occurs. The remainder of the Buffer_B data is used to provide the extension pixel data (PIXEL_DATA_EXTENSION) that is valid only for a single buffer pixel, when the upper part of Buffer_B matches the double buffer reject value, as indicated by the output of NEQ 122 (EXTENSION_INVALID). Otherwise, the pixel is operating in the double buffer display mode and the each sub-pixel field contains valid output pixel data.

The output of NEQ logic block 122 is logically ANDed with the BUFFER_SELECT signal by ANDgate 118, providing an output that controls the multiplexer 120. If the output of the ANDgate 118 is 0, then display pixel data from Buffer_A is accessed over port 0 of MUX 120 and output as display pixel data to pixel processing circuitry 130. Depending upon whether EXTENSION_INVALID is set, the display pixel data is processed by itself or in combination with the PIXEL_DATA_EXTENSION to produce the RGB pixel data provided to RGB DACs 116. If the output of ANDgate 118 is 1, then the entire sub-pixel field of Buffer_B for that pixel is accessed by MUX 120 over port 1 and output as pixel data to pixel processing circuitry 130 and thence to RGB DACs 116.

The output of the NEQ logic block 122 is used to indicate the validity of the extended pixel data (PIXEL_DATA_EXTENSION) from the Buffer_B field. As will be appreciated, this signal will indicate the width and format of the pixel data to be processed for that particular single buffer pixel. If a match occurs between the upper part of Buffer_B and DBR_VALUE, then the double buffer display is rejected and the NEQ logic block 122 output drives the extension invalid signal (EXTENSION_INVALID) to 0, indicating the validity of the extended pixel data (PIXEL_DATA_EXTENSION). If no match occurs between the upper part of Buffer_B and the double buffer reject value (DBR_VALUE), then the double buffer is not rejected and the NEQ logic block 122 output drives EXTENSION_INVALID to 1, indicating that the extended pixel data is invalid and that the display pixel data in Buffer_B is part of a double buffer display pair.

While the invention has been particularly shown and described with reference to a preferred embodiment, it will be understood by those skilled in the art that various changes in form and detail may be made therein without departing from the spirit and scope of the invention.

What is claimed is:

1. A graphics display subsystem that allows rejection of double buffer display of pixel data in a graphics layer, comprising:

a double buffer reject circuit that compares one or more bits of each double buffer sub-pixel field of a given pixel with a predetermined double buffer reject value to determine equality of the one or more bits and the predetermined double buffer reject value, wherein the given pixel is represented by binary bits and wherein the given pixel is divided into two or more sub-pixel fields including one or more double buffer sub-pixel fields, and wherein the double buffer reject circuit receives a buffer select signal selecting one of the two or more sub-pixel fields of the given pixel to be accessed during a current display frame, the double buffer reject circuit accessing the selected sub-pixel field of the given pixel when the buffer select signal does not select a double buffer sub-pixel field or when the buffer select signal selects a particular double buffer sub-pixel field and the comparison for that particular double buffer sub-pixel field does not show equality, and further the double buffer reject circuit accessing a predetermined one of the two or more sub-pixel fields of the given pixel when the buffer select signal selects a particular double buffer sub-pixel field and the comparison for that particular double buffer sub-pixel field shows equality.

2. A graphics display subsystem according to claim 1, further comprising a digital-to-analog converter in communication with the double buffer reject circuit that receives the pixel data contained in the sub-pixel field accessed by the double buffer reject circuit and converts the pixel data into analog video signals for driving a monitor display device.

3. A graphics display subsystem according to claim 1, further comprising a memory containing a plurality of pixels represented by binary bits, wherein each pixel is divided into two or more sub-pixel fields including a double buffer sub-pixel field, and wherein one or more bits of a double buffer sub-pixel field of a given pixel are set to a predetermined double buffer reject value when the given pixel corresponds to a single buffer display application, and wherein the sub-pixel pixel fields of the plurality of pixels contained in the memory are accessed by the double buffer reject circuit.

4. A graphics display subsystem according to claim 1, wherein the double buffer reject circuit outputs an extension invalid signal that is set when the comparison does not show equality for a given pixel, and wherein one or more bits in the double buffer sub-pixel field of the given pixel are accessed as extended pixel data when the extension invalid signal is not set and the buffer select signal does not select the double buffer sub-pixel field.

5. A graphics display subsystem according to claim 4, wherein an digital-to-analog converter receives the extended pixel data and converts the extended pixel data, in combination with the pixel data contained in the accessed sub-pixel field, into analog video signals.

6. A graphics display subsystem according to claim 1, wherein the one or more bits of the double buffer sub-pixel field of a given pixel is equal to the number of bits for the entire sub-pixel field.

7. A graphics display subsystem according to claim 1, wherein the one or more bits of the double buffer sub-pixel field of a given pixel is equal to one bit.

8. A method in a graphics display subsystem of double buffer display rejection in a graphics layer, the method comprising the steps of:

comparing one or more bits of a double buffer sub-pixel field of a given pixel with a predetermined double buffer reject value to determine equality of the one or more bits and the predetermined value, wherein the given pixel is represented by binary bits and wherein the given pixel is divided into two or more sub-pixel fields including the double buffer sub-pixel field;

receiving a buffer select signal selecting one of the two or more sub-pixel fields of the given pixel to be accessed during a current display frame;

accessing the selected sub-pixel field of the given pixel when the buffer select signal does not select the double buffer sub-pixel field or when the buffer select signal selects the double buffer sub-pixel field and the comparison does not show equality; and accessing one of the two or more sub-pixel fields of the given pixel that is not the double buffer sub-pixel field when the buffer select signal selects the double buffer sub-pixel field and the comparison shows equality.

9. A method in a graphics display subsystem of double buffer display rejection in a graphics layer according to claim 8, further comprising the step of transmitting the pixel data contained in the accessed sub-pixel field and converting the transmitted pixel data into analog video signals for driving a monitor display device.

10. A method in a graphics display subsystem of double buffer display rejection in a graphics layer according to claim 8, further comprising the step of a memory containing a plurality of pixels represented by binary bits, wherein each pixel is divided into two or more sub-pixel fields, and wherein one or more bits of a double buffer sub-pixel field of a given pixel are set to a predetermined double buffer reject value when the given pixel corresponds to a single buffer display application, and wherein the sub-pixel fields of the plurality of pixels contained in the memory are accessed by the double buffer reject circuit.

11. A method in a graphics display subsystem of double buffer display rejection in a graphics layer according to claim 8, further comprising the step of outputting an extension invalid signal that is set when the comparison does not show equality for a given pixel, and wherein one or more bits in the double buffer sub-pixel field of the given pixel are accessed as extended pixel data when the extension invalid signal is not set and the buffer select signal does not select the double buffer sub-pixel field.

12. A method in a graphics display subsystem of double buffer display rejection in a graphics layer according to claim 11, further comprising the step of receiving the extended pixel data and converting the extended pixel data, in combination with the pixel data contained in the accessed sub-pixel field, into analog video signals.

13. A method in a graphics display subsystem of double buffer display rejection in a graphics layer according to claim 8, wherein the step of comparing one or more bits of the double buffer sub-pixel field of a given pixel with the predetermined value comprises comparing all bits in the sub-pixel field with the predetermined value.

14. A method in a graphics display subsystem of double buffer display rejection in a graphics layer according to claim 8, wherein the step of comparing one or more bits of the double buffer sub-pixel field of a given pixel with the predetermined value comprises comparing one bit in the sub-pixel field with the predetermined value.

15. A graphics display subsystem that allows rejection of double buffer display of pixel data in a graphics layer, comprising:

a comparator that compares one or more bits of a double buffer sub-pixel field of a given pixel with a predetermined double buffer reject value to determine equality of the one or more bits and the predetermined value, wherein the given pixel is represented by binary bits and wherein the given pixel is divided into two or more sub-pixel fields including the double buffer sub-pixel field;

an ANDgate that receives inputs of a buffer select signal selecting one of the two or more sub-pixel fields of the given pixel to be accessed during a current display frame and the output of the comparator and generating an output indicating the logical ANDing of the inputs; and a multiplexer controlled by the ANDgate output, wherein a binary zero ANDgate output selects a first sub-pixel field of the two or more sub-pixel fields that is not the double buffer sub-pixel field as the output of the multiplexer and a binary one ANDgate output selects the double buffer sub-pixel field as the output of the multiplexer.

16. A graphics display subsystem according to claim 15, further comprising a digital-to-analog converter in communication with the multiplexer that receives the pixel data output by the multiplexer and converts the pixel data into analog video signals for driving a monitor display device.

17. A graphics display subsystem according to claim 15, further comprising a memory containing a plurality of pixels represented by binary bits, wherein each pixel is divided into two or more sub-pixel fields, and wherein one or more bits of a double buffer sub-pixel field of a given pixel are set to a predetermined double buffer reject value when the given pixel corresponds to a single buffer display application, and wherein the sub-pixel fields of the plurality of pixels contained in the memory are selected by the multiplexor.

18. A graphics display subsystem according to claim 15, wherein the output of the comparator is an extension invalid signal that is set when the comparison does not show equality for a given pixel, and wherein one or more bits in the double buffer sub-pixel field of the given pixel are presented as extended pixel data when the extension invalid signal is not set and the buffer select signal does not select the double buffer sub-pixel field.

19. A graphics display subsystem according to claim 18, further comprising a digital-to-analog converter in communication with the multiplexer that receives the pixel data output by the multiplexer and converts the pixel data into analog video signals for driving a monitor display device, and wherein the digital-to-analog converter receives the extended pixel data when presented and converts the extended pixel data, in combination with the pixel data of the accessed pixel, into analog video signals.

20. A graphics display subsystem according to claim 15, wherein the one or more bits of the double buffer sub-pixel field of a given pixel is equal to the number of bits for the entire sub-pixel field.

21. A graphics display subsystem according to claim 15, wherein the one or more bits of the double buffer sub-pixel field of a given pixel is equal to one bit.

* * * * *